United States Patent [19]

Cork et al.

[11] 4,364,975

[45] Dec. 21, 1982

[54] METHOD OF AND APPARATUS FOR PRODUCING ASPHALT SATURATED FIBERBOARD

[75] Inventors: Dale J. Cork, Elgin, Ill.; Russell Pellman, deceased, late of West Dundee, Ill., by Marguerite Pellman, executrix

[73] Assignee: W. R. Meadows, Inc., Elgin, Ill.

[21] Appl. No.: 278,797

[22] Filed: Jun. 29, 1981

[51] Int. Cl.[3] ..... B05D 3/00; B05D 3/12; C23C 13/08

[52] U.S. Cl. ..... 427/294; 118/50; 118/429; 427/298; 427/350; 427/351

[58] Field of Search ..... 118/50, 429; 427/294, 427/296, 297, 298, 351

[56] References Cited

U.S. PATENT DOCUMENTS 1,163,270 12/1915 Shipley ..... 427/298

4,233,929 11/1980 Hurst et al. ..... 118/50

*Primary Examiner*—Michael R. Lusignan

*Attorney, Agent, or Firm*—Horace B. Van Valkenburgh

[57] ABSTRACT

A tank having a hinged top and sealing means is provided with a series of heaters mounted on the inside of the front, rear and side walls and also the bottom of the tank. A rack containing fiberboards placed in upright, spaced position is set on the bottom heaters and a solution of solvent and asphalt or the like is pumped into the tank, then removed. The top of the tank is sealed and a heating medium is pumped through the heaters, while a vacuum pump is started to produce a vacuum inside the tank and suction exerted for evaporating solvent. One or two condensers, between the tank and the vacuum pump, condense the solvent vapors for collection and reuse. With one condenser, an excess condensate tank is connected to the lower condensate section of the condenser. A valved pipe connecting with the pipe between a lower condensate section of the condenser and the vacuum pump is utilized to bleed air into the tank after treatment and may be used to control the initial vacuum applied. The heat supplied by the heaters should be sufficient to maintain the temperature within the tank, at the point of measurement, above the boiling point of the solvent at a low vacuum, while the heating oil is supplied at a temperature substantially in excess of the normal boiling point of the solvent.

18 Claims, 7 Drawing Figures

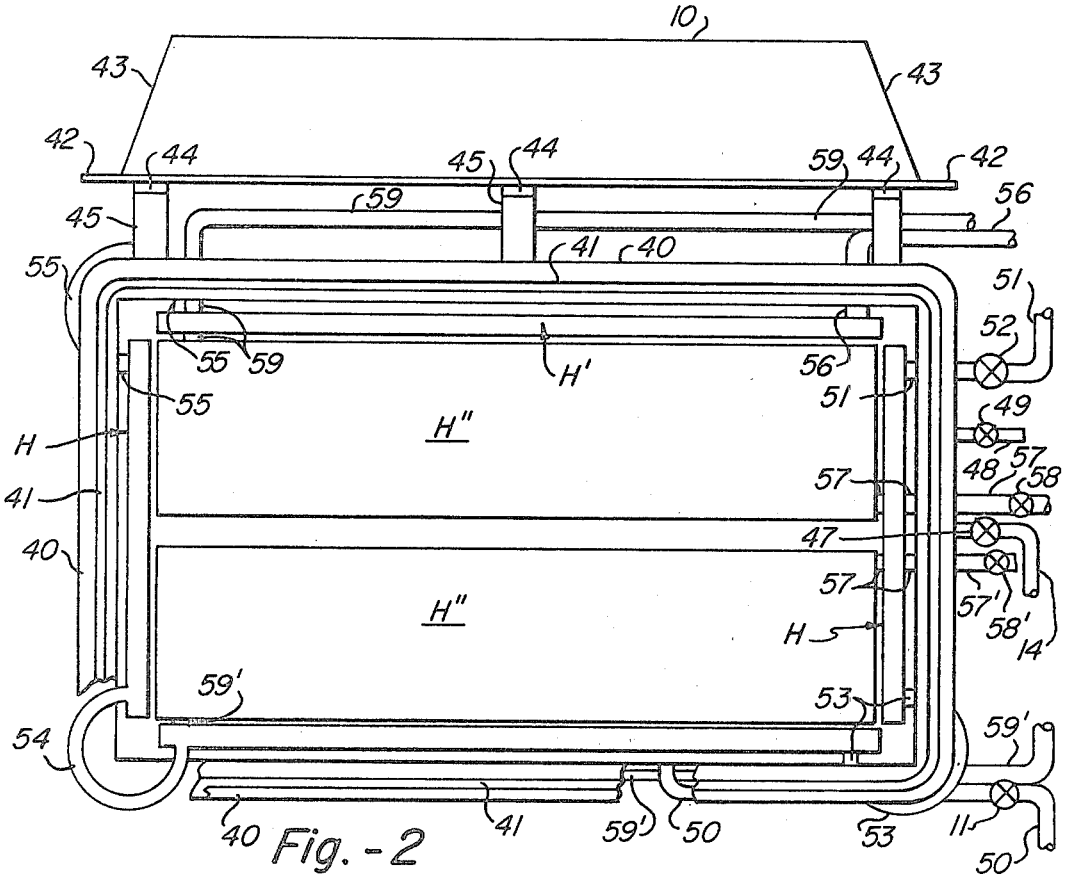
Fig. - 2
Fig. - 3
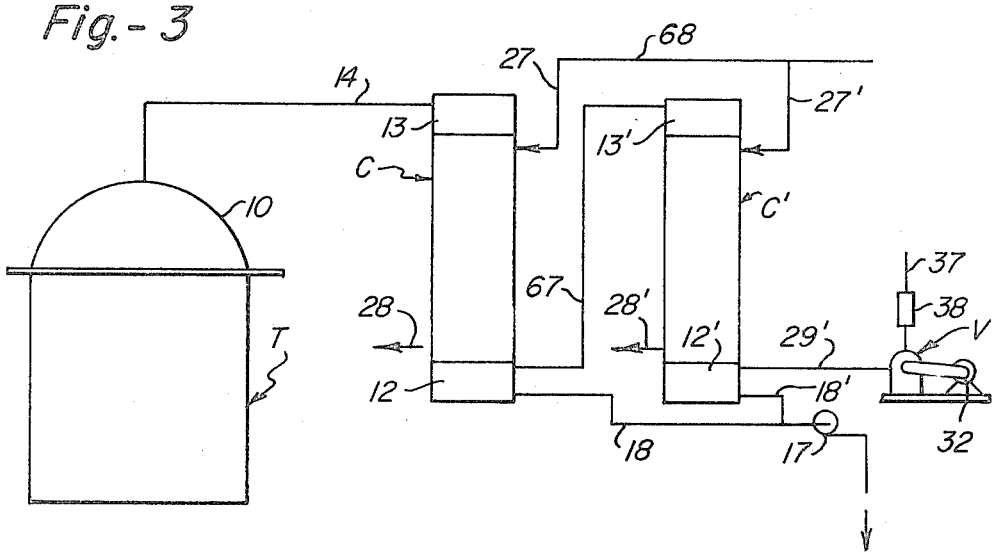

METHOD OF AND APPARATUS FOR PRODUCING ASPHALT SATURATED FIBERBOARD

This invention relates to a method of and apparatus for the production of fiber board substantially saturated with asphalt, as for use in producing fiber expansion joint fillers.

BACKGROUND OF THE INVENTION

A fiber expansion joint filler should be non-extending, resilient and should not deform, twist or break with ordinary handling. It is composed of cellular fibers securely bonded together and uniformly saturated with asphalt to insure longevity. It should have excellent resiliency and should be unaffected by temperature extremes. A fiber expansion joint filler is ideally suited for joints in sidewalks, driveways, single and multi-level floor slabs and the like, i.e. all areas where expansion and contraction stresses in concrete have to be accommodated to prevent failure. It is particularly suited for highways, municipal streets, airport runways, and similar areas subject to vehicular traffic. Fiber expansion joint fillers are normally produced by cutting an asphalt saturated fiber board into strips of a desired width and length.

Previously, fiber boards to be saturated have been dipped into a solution of asphalt and a solvent, to carry the asphalt and solvent into the fiber board, which is comparatively porous and into which a liquid passes quite readily. Upon removal from the solution, the fiber boards have been taken to a field and placed with spacers between boards so that the solvent could evaporate in the open air, such as in about two weeks or more, depending on the temperature, humidity and winds. There are numerous distinct disadvantages to this procedure. One marked disadvantage is the cost of the solvent, which is all lost to the open air. A second disadvantage is the cost of labor involved in placing the saturated boards individually on spacers for evaporation of the solvent. A third disadvantage is the effect of inclement weather, such as during rainfall and particularly when it is snowing. A fourth disadvantage is pollution of the atmosphere. It is understood that one manufacturer of asphalt saturated fiber board was forced to close its plant in one state, while another operating in another state under a "grandfather clause" was prevented from moving its fiber board saturation operation to a new site where an expanded plant was to be located, because of pollution problems.

In order to recover as much of the solvent as possible, the present applicants and possibly others associated with the assignee of the present application, developed equipment including a tank adapted to be closed so that a vacuum could be pulled on the tank and the pressure reduced to evaporate the solvent from fiber boards placed in the tank, then condensed and the solvent recovered. The fiber boards were placed in a special rack constructed for the purpose and placed in the tank, with the boards therein. The top of the tank was closed, sealed and clamped and then a blend of solvent and asphalt pumped into the tank, then pumped out. Then the pressure within the tank was reduced by a vacuum pump connected in series with a coiled condenser. Some heat was attempted to be applied to the solution remaining on the boards through a few channels welded to the inside of the tank and a heat transfer oil, at 350° to 400° F., passed through the spaces provided by the channels. For the first few minutes, as vacuum was applied, there was a rush of solvent vapor into the condenser, which tended to flood the condenser and, at times, carry over into the vacuum pump and escape into the atmosphere. While a portion of the solvent was recovered, a larger portion remained on or in the boards, so that the expense of placing the boards for drying outdoors and the loss of the solvent evaporated there was not avoided. It was found that it required six days or more to reduce the solvent remaining in the boards to an acceptable amount, i.e. the amount of solvent normally locked in the asphalt or about 6% or less of solvent in proportion to the asphalt.

Among the objects of this invention are to provide a novel method of and apparatus for treating fiber board so as to substantially saturate the boards with asphalt or the like; to provide a method and apparatus which involves a blended solution of solvent and asphalt; to provide such a method and apparatus by which such boards may be subjected to immersion or substantial immersion in such solution, the solution drained and the boards then subjected to vacuum and heat to remove the solvent; to provide such a method and apparatus by which the solvent may be removed by heat and vacuum to a similar extent as though the boards, after the solution is drained from them, were placed individually in the atmosphere for drying for an extended period, as on the order of two weeks or more; to provide such a method and apparatus which recovers substantially all of the solvent, except that which is "locked in" with asphalt; to provide such a method which may be carried out with ease and facility and such apparatus which is particularly adapted to carry out such method; and to provide such method which can be carried out economically and such such apparatus which is economical in operation.

SUMMARY OF THE INVENTION

Apparatus of this invention, particularly adapted to carry out the method thereof, includes a rectangular tank having a hinged top which is dome shaped to avoid drippage from condensation and which is provided with means, such as a rim for clamping to a rim of the tank, with a rubber-like gasket between the rims, for sealing the top and the tank. The tank is provided with a series of heaters on the inside, spaced slightly from the inner surfaces of the tank and conforming in shape to the front, rear and side walls and also the bottom of the tank, but relatively thin with respect to the lateral and longitudinal dimensions. A heating medium, such as a heat transfer oil, is circulated through each heater, which may be baffled on the inside to produce a circuitous path for the heating medium. A loader rack on which the fiber boards to be treated are placed in upright, longitudinal positions, is lowered within the tank, resting on the heaters at the bottom of the tank and the top sealed. A blended solution of solvent and asphalt is pumped into the tank until it covers the upper edges of the boards and is then pumped out. The solution is allowed to drain from the boards and the drainage is pumped out, then an air vent is closed and a vacuum pump is started, then the heating medium is introduced into the heaters. A line from the tank, having a valve which is opened when the vacuum pump is started, leads to an upper inlet section of an upright condenser having fluid cooled passages, in which solvent vapors sucked out of the tank are condensed to fall into a lower condensate solution. The inlet of the vacuum pump may be connected to the upper portion of the condensate section of the condenser, with an auxiliary tank connected to the upper and lower portions of the condensate section to receive a portion of the volume of condensate produced by the initial rush of vapor for the first few minutes over which vacuum is initially applied. Or, the one condenser may be in series with a second condenser, such as similar to the first, through a pipe connecting the upper portion of the condensate section of the first condenser with the upper inlet section of the second condenser, whose lower condensate section is connected by a pipe with the vacuum pump.

All of the motors, pumps, switches and hoists of the apparatus should be explosion proof, since the solvent can be highly flammable. A tank to receive the condensed solvent, pumped therein from the condensate section of the one or both condensers, is preferably buried. The tanks containing asphalt and solvent, and the mixture thereof, as well as the equipment for heating the blend of asphalt and solvent, are placed at a position remote from the treatment tank.

In the method, sufficient heat is supplied, while suction is being applied to produce a vacuum, to maintain the boards and the solvent solution at a temperature which will effectively evaporate substantially all of the solvent which is not "locked in" with the asphalt. This is accomplished by supplying heaters within the tank and particularly on the bottom of the tank with a heating medium at a temperature substantially in excess of the normal boiling point of the solvent and increasing the flow of heating medium during the application of vacuum. The temperature within the tank should be maintained, at the point of measurement, in excess of the boiling point of the solvent at a low vacuum.

THE DRAWINGS

FIG. 2 is a top plan view of a tank in which boards are placed to be treated, but with the top open prior to receiving a rack for the boards.

FIG. 3 is a diagrammatic front elevation, on a reduced scale, showing particularly an alternative condenser and vacuum pump arrangement.

DESCRIPTION OF THE PREFERRED EMBODIMENT

The blended solution by which the fiber board is essentially saturated with asphalt is a blended solution of asphalt in a solvent which will carry the asphalt into the fiber board and can subsequently be evaporated. The solvent should be one in which the asphalt will readily dissolve at a reasonable temperature. The preferred asphalt is an AC-5 or paving grade asphalt of 120–150 penn, although other types of asphalt may be found suitable. The preferred solvent is Laktane solvent available from Exxon Company, although a naphtha or other types of solvents may be used. Thus, the requirement for the solvent is that it dissolve the asphalt readily, that it carry the asphalt into the fiber boards with comparative ease and that it evaporate at temperatures at which the asphalt will remain in the boards. The preferred Laktane is state to be generally a mixture of $C_7$ and $C_8$ hydrocarbons, with over 50% cycloparaffins and a fairly high proportion of aromatics, mostly toluene. It is preferred over a naphtha because of its lower boiling point and the lower temperature to which the saturated boards must be heated to remove solvent. Laktane has the following specification:

| | |
|---|---|
| Aniline point (ASTM D611) | 28–36° C., 83–98° F. |
| Appearance, visual | Bright and clean |
| Aromatics content (ASTM D1319) | 23.0% max., by vol. |
| Bromine Index (ASTM D2710) | 0.5% max., by vol. |
| $C_8$ + aromatics content (ASTM D2267) | 0.5% max., by vol. |
| Distillation (ASTM D1078) | |
| Initial boiling point | 99° C., 211° F. min. |
| End point | 110° C., 230° F. max. |
| Specific gravity (ASTM D1250) 15.6/15, 6° C., 60°/60° F. | 0.75–0.780 |
| Sulfur content ppm (Microcoulometer) | 10 max. |

The blended solution preferably contains 37%±2%, of asphalt by weight, although other percentages could be used, depending on the use to which the boards are put. It is mixed by metering the asphalt and solvent into a pipeline and then pumping into a storage tank, in which the solution is maintained at approximately 190° F. or 88° C. The storage tank is placed away from the treatment area, to reduce fire danger.

Figure 1:
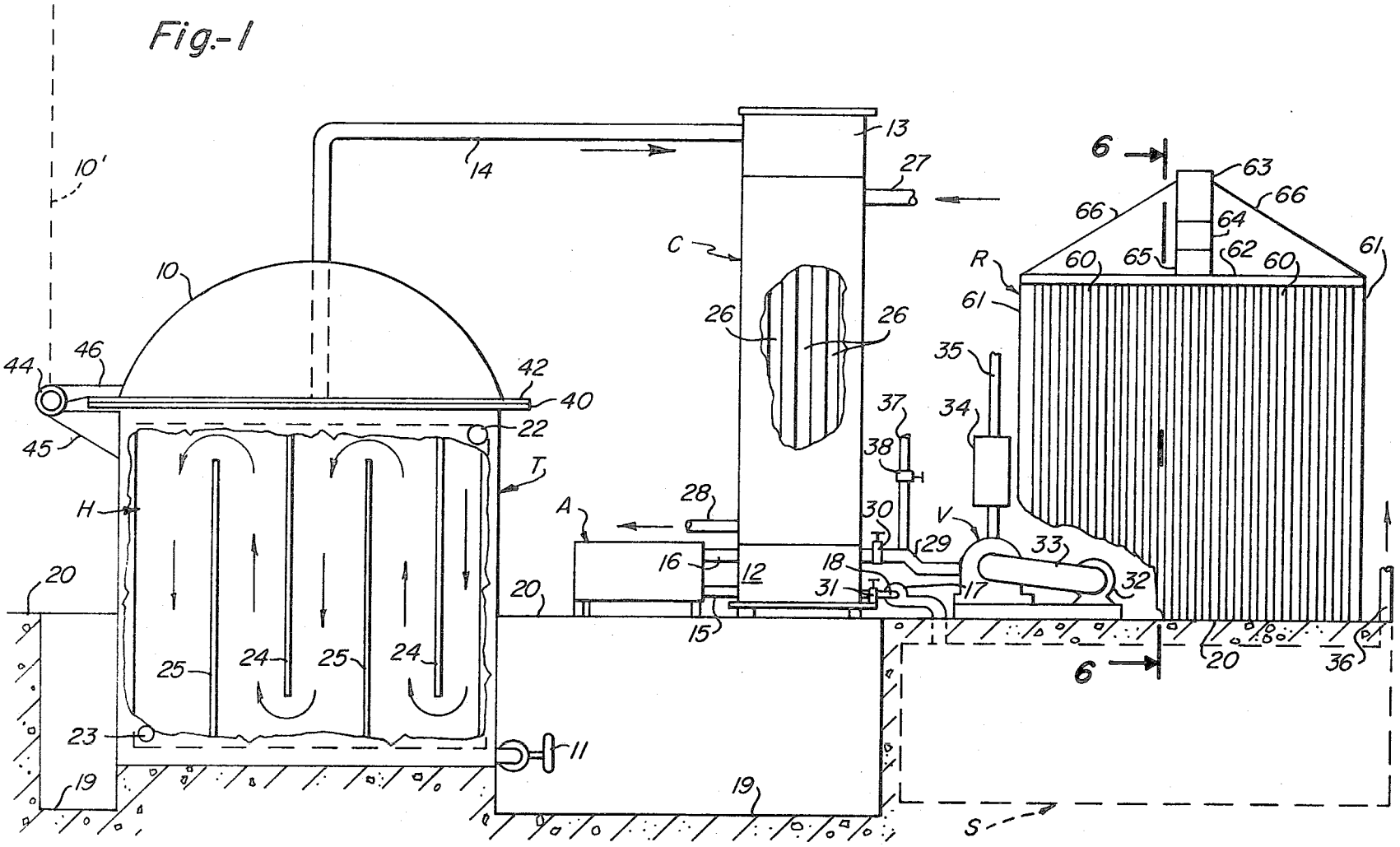
FIG. 1 is a side elevation, partly in section, showing an installation of apparatus constructed in accordance with this invention and particularly adapted to carry out the method of this invention.

Apparatus particularly adapted to carry out the method of this invention is illustrated in FIG. 1 and includes a treatment tank T having a hinged top 10 which is dome-shaped to prevent condensate from dripping onto the boards toward the end of the removal process, which can cause spotting of the boards, and which may be opened to receive a rack R loaded with fiber boards. The tank is then closed and its edges clamped, in a manner described later, for introduction of the solution of asphalt and solvent, as by opening an inlet valve 11. The treating solution is pumped in until the tops of the boards are covered, then the pumps are stopped and alternate pumps are started to withdraw the solution from the tank. After initial withdrawal, the pumps are stopped to provide time for drainage, such as three minutes elapsing before the withdrawal pumps are started again. The tank is also provided with a series of heaters, such as heaters H of FIGS. 1 and 2, on each end wall, a heater H′ on the front and rear walls and bottom heaters H″, as in FIG. 2, each being inside the tank but spaced slightly from the respective wall or bottom. A heating medium, such as a conventional heat transfer oil, is supplied to heaters H, H′ and H″ when the application of vacuum is started, to insure that the solution remaining on the boards will be vaporized, after the drainable solution is removed from the tank. The heaters H, H′ and H″ play an important part in this invention, since they must have a heating capacity sufficient to maintain the interior of the tank at a temperature, at the point of measurement, in excess of the boiling point of the solvent at a low vacuum. Thus, the heating oil is maintained in a storage tank away from the treatment area at a temperature considerably in excess of the normal boiling point of the solvent, such as by heating to 450° F. to 475° F., so that the heat transfer oil will be supplied to the heaters H, H' and H'' at a temperature of 440° F. to 470° F. when the solvent has a normal boiling point of the preferred Laktane solvent, i.e. in the 211° F. to 230° F. range, such as approximately 221° F. The vacuum pump V is connected to a lower condensate section 12 of a condenser C, an upper inlet section 13 of which receives solvent vapor through a pipe 14 from the sealed tank T when vacuum is started, after the solution has drained and the collected solution pumped out. When the vacuum is first drawn on the closed and sealed tank T, for the first few minutes there will be a rush of solvent vapors into the condenser C. An auxiliary tank A may be connected to the lower section 12 of the condenser C by a lower condensate pipe 15, through which condensate flows to tank A to relieve flooding, and an upper pipe 16 to maintain the same pressure above the condensate in tank A, as in section 12. As condensate collects in the lower section of condenser C, it is transferred to a recovered solvent tank S by a pump 17, through a pipe 18.

Tank T is installed within a pit 19 which will catch any solution discharged from the tank, in the event of an accident, and also lowers the tank so as to reduce the height to which rack R must be elevated, as by an overhead hoist on a track, in moving the rack from floor or ground level 20 into or out of tank T. Such movement is made with the cover 10 pivoted upwardly to the position of FIG. 2, which corresponds to the dotted line 10 of FIG. 1, and is opposite the front edge of the tank over which the rack is moved. Condenser C, vacuum pump V and auxiliary tank A are mounted at ground level 20 adjacent the opposite end of pit 19, while rack R is positioned for loading, unloading and storage, at ground level adjacent the front of pit 19 and opposite tank T. Heater H may be provided with an inlet 22 and a diametrically opposed outlet 23, as well as alternating baffles 24 and 25 which alternate in being spaced from the top and bottom of the unit and insure a circuitous path of flow of the heating fluid, indicated by the arrows. The other heater H and heaters H' and H'' of FIG. 2 may be similarly constructed. The top and bottom of the heater H are shown in FIG. 1 in dotted lines.

Condenser C is provided with cooling tubes 26 which extend from upper section 13 to lower section 12 and around which cooling fluid flows, from an inlet 27 to an opposed outlet 28, as indicated by the arrows. A pipe 29, provided with a shuttoff valve 30, connects the upper end of lower condensate section 12 of the condenser with the vacuum pump V, while a similar valve 31 is installed in pipe 18. Vacuum pump V is driven by an explosion proof motor 32 and an enclosed drive 33. A storage tank 34, for lubricating oil and liquid seal for rotary pistons in the vacuum pump, may be mounted on discharge pipe 35 for the vacuum pump. Solvent tank S is buried, as shown, but is located laterally from pit 19, being adjacent pump V, and is provided with a vent 36. A pipe 37 may connect with pipe 29 and may be provided with a valve 38 for reducing the vacuum if the flow of vapor into condenser C is too great.

Tank T, as in FIGS. 1 and 2, is provided with an upper rim 40 extending outwardly from the periphery of the tank and having a seal strip 41, such as formed of Buna rubber, which is clamped between rim 40 of the tank and a corresponding rim 42 of the cover 10. For sealing purposes, the rims 40 and 42, in the position of FIG. 1, are clamped together by heavy duty C-clamps, at spaced positions around the rims. Cover 10, which is arcuate in cross section but has flat ends 43 which taper upwardly and inwardly, is pivotal between the closed position in FIG. 1 and the open position of FIG. 2 on hinges 44, each mounted on a bracket 45 extending from tank T and attached by an arm 46 to the cover 10, as in FIG. 1. Pipe 14, leading to the condenser C, is provided with a valve 47, while a vent line 48 is provided with a valve 49 and an inlet pipe 50 is provided with valve 11, referred to previously.

A heater H, as in FIG. 2, is installed in a position spaced from each end wall of tank T, while longer heaters H' are installed in a position spaced from the front and rear walls of the tank. A pair of heaters H'', extending longitudinally, may be supported by the floor of the tank and in turn provide a support for the rack R with the fiberboards to be treated placed therein. Heater H, at the right in FIG. 2, is similar in construction to that shown in FIG. 1, while heaters H' and H'' are similarly constructed, i.e. with alternating baffles. The heat transfer oil may be supplied to the upper rear corner of the right heater H by a pipe 51 having a valve 52 therein, while the heat transfer oil may be transferred to the front heater H' by an arcuate pipe 53 joining the lower corners thereof. Similarly, the heating fluid may be transferred from front heater H' to inlet 22 of heater H of FIG. 1 by an arcuate pipe 54 connecting the upper corners thereof and from outlet 23 to rear heater H' by an arcuate pipe 55 connecting the lower corners thereof. The heating fluid may be discharged from the upper right corner of rear heater H' through a pipe 56. Heaters H'' may be supplied with heating fluid by pipes 57 and 57', respectively, each leading to an inside corner thereof adjacent vapor pipe 14 and having a valve 58 and 58', respectively, therein. The heat transfer oil flows along a circuitous path through each heater H'', in a manner similar to the flow illustrated for heater H in FIG. 1, and is discharged from adjacent the opposite outside corner, through pipes 59 and 59', respectively. Pipes 51, 57 and 57' may be supplied through a main heat transfer line (not shown) having a diameter approximately twice that of pipes 51, 57 and 57'.

The portions of rack R shown in FIG. 1, other details of which will be described later in connection with FIGS. 6 and 7, include a front set of parallel spacing bars 60 which are inclined upwardly and rearwardly to facilitate the movement of boards past them, i.e. to prevent impact of a 90° edge of a board with a bar at 90° to the horizontal. Bars 60 may be rectangular in cross section, having a depth, from front to back, greater than the thickness and are spaced apart to provide space between each adjacent pair of bars to slip a fiber board, as of one inch or lesser thickness, such as $\frac{3}{4}$ in., $\frac{1}{2}$ in., $\frac{3}{8}$ in. or $\frac{1}{4}$ in. The rack shown can accommodate 60 boards of $\frac{1}{2}$ or $\frac{3}{4}$ in. in thickness and up to 12 feet in length and 4 feet in width, placed on edge in a vertical position. For best results, only 50 one inch boards are placed in the rack since it is desirable to leave an additional space between each group of five boards, to facilitate heating and evaporation of the solvent. Also, the rack can accommodate 120 boards of $\frac{1}{4}$ in. or $\frac{3}{8}$ in. in thickness, since two of such boards can be placed in a slot between two bars 60. The portion of rack R shown in FIG. 1 also includes a pair of front corner posts 61, such as angles, and a top front rail 62, such as formed by a length of pipe. A central lifting post may be formed by an upper set of links 63, pivotally attached to a lower set of links 64, in turn pivotally attached to a pair of side plates 65 of a base, with other details described later. The upper links 63 may be attached to each of the four corners of the rack by cables 66, which reduce stress at the center of the rack upon hoisting.

In FIG. 3 is illustrated an alternative embodiment, in which the tank T, pipe 14, condenser C and vacuum pump V are essentially the same as in FIG. 1. A second condenser C′ is interposed between condenser C and vacuum pump V, in order to accommodate the surge in vapor as the vacuum is initially applied, since the condenser C′ not only adds additional condensing capability, but also separates the condenser C from the vacuum pump V. Excess condensate in lower section 12 of condenser C cannot flow to pump V but must first pass over into condenser C′, along with any uncondensed vapors, and collect in lower section 12! of condenser C′. Thus, a pipe 67 connects the upper end of lower section 12 of condenser C with upper section 13′ of condenser C′ and a pipe 29′ connects the upper end of lower section 12′ of condenser C′ with vacuum pump V. A fluid supply pipe 68 connects with inlet pipe 27′ of condenser C′ and inlet pipe 27 of condenser C, while outlet pipes 28 and 28′ may be similarly manifolded. The cooling fluid may be water or other liquid, such as a refrigerant. Pipe 18 leads from the lower end of lower section 12 of condenser C to pump 17, while a branch 18′ from condenser C′ connects therewith, for discharge of condensed solvent into storage tank S of FIG. 1.

While the vacuum is applied to the tank, heat transfer oil is supplied to the heaters H, H′ and H″, as at 440° F. to 470° F. After the drained solution has been removed, the valve 49 in vent line 48, which leads to the storage tank for the solvent, is closed and the vacuum pump V started. During the first few minutes of vacuum application, there will be surge of vapor into condenser C, which thus may be temporarily overloaded and there may be some solvent vapor mixed with air, which is withdrawn from inside the tank. The initial increase in vacuum may be retarded by opening valve 38 to permit air to bleed through pipe 37 into suction pipe 29 for the vacuum pump. It will be noted that a pump which is capable of pulling the interior of the tank down to 25 to 28 inches of vacuum will exert a more pronounced effect at the start. The production of vapor tends to cool the boards through evaporation and thus decrease the temperature of the remaining solvent, but as the vacuum in the tank increases, the boiling point of the solvent decreases, thus compensating somewhat for cooling by continued evaporation. However, sufficient heat must be supplied, as by starting additional circulating pumps and automatically opening further valves 52, 58 and 58′, so that a large quantity of heat transfer oil is supplied from a hot oil heater, to flow at an increased rate through each of the heaters H, H′ and H″. It has been found that the desired results have been obtained when the temperature inside the dome of the tank is at least 200° F., since it was less than 200° F., in the prior operation which did not remove enough solvent and required 6 days or more of atmospheric evaporation. Typically, the temperature in the tank, beneath cover 10, has been 220° F. at the start of the vacuum operation, has dropped to 210° F. and then has risen to 215° F. It will be noted that these temperatures are each higher than the boiling point of the preferred Laktane at 5 in. vacuum, i.e. approximately 209° F. After the desired vacuum is obtained, such as in the 25 to 28 inch range, the circulating oil pumps may be stopped and the vacuum broken by opening valve 38 to bleed air into the tank through pipe 14.

Figure 4:
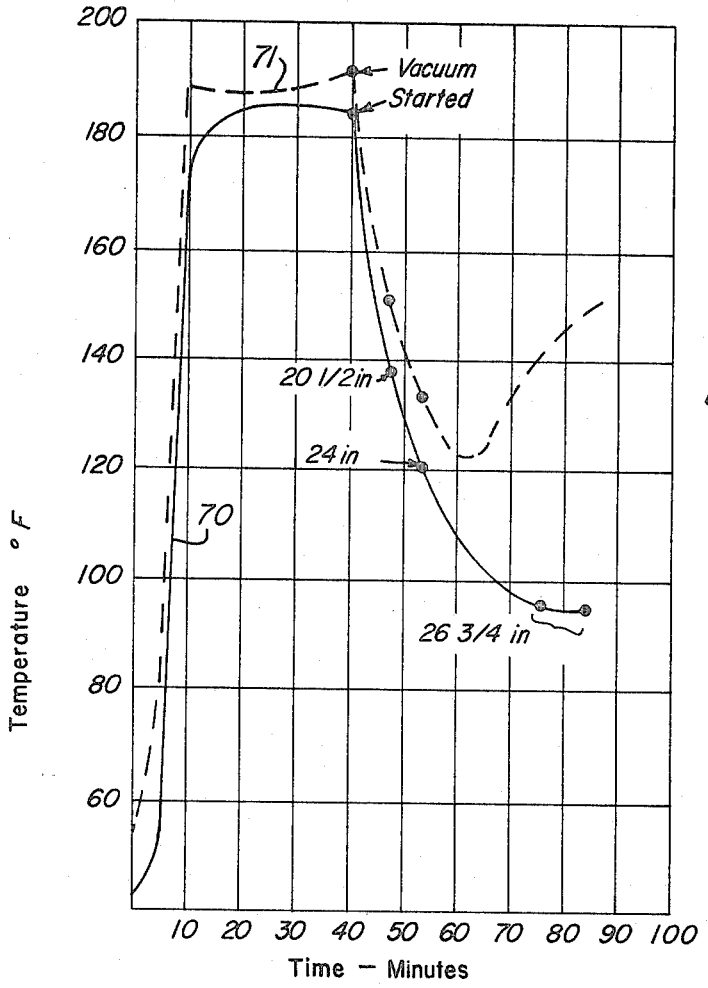
FIG. 4 is a graph showing the temperature of the inside and outside boards in the rack during treatment.

In FIG. 4 is shown the result of measurement of temperatures by thermocouple probes inserted into the interior of two boards during a saturation treatment of ½ in. boards in accordance with this invention, with the temperature readinings in °F. plotted against time in minutes. One was an inside board, i.e. the interior of the rack, shown by solid curve 70, and the other an outside board, i.e. on the outside of the rack, shown by dotted curve 71. The point at which vacuum was started, at 40 minutes into the treatment, as indicated on each curve. It will be noted that the temperature of both boards increased relatively rapidly for the first ten minutes, with the outside board starting and continuing at a higher temperature but then leveling off and increasing slightly, while the inside board continued to increase but then leveled off. After the vacuum was started, the temperature of both the inside and outside boards dropped sharply, apparently due to evaporation of the solvent. It will be noted that, when treated ½ in. board, a vacuum of 21 inches is usually obtained in approximately 8 minutes or less, after the vacuum is initiated, but that a vacuum of 25 to 28 inches is usually obtained in about 35 minutes after vacuum is started. After 25 minutes of vacuum, the temperature of the outside board began to climb and continued upward for the duration of the treatment, but the temperature of the inside board continued to reduce. The usual vacuum time for different thickness of boards approximates the following, it being noted that twice as many ¼ in. or ⅜ in. boards may be placed in the rack than greater thicknesses.

¼ in. board: 45 minutes
⅜ in. board: 1 hour
½ in. board: 45 minutes
¾ in. board: 1 hour 10 minutes
1 inch board: 1 hour 20 minutes As shown in FIG. 4, the temperature inside the boards themselves is less than the boiling point of the solvent at a number of points, such as when vacuum is applied and for the remainder of the treatment for the board on the interior of the rack, represented by curve 70. Also, the temperature inside the board on the outside of the rack, represented by curve 71, was also less than the boiling point of the solvent at the vacuum involved, until the sharp upturn after 25 minutes of vacuum, i.e. 65 minutes of total treatment. This upturn is believed to indicate that all of the solvent in that board had been evaporated, except that locked in with the asphalt. Of course, the outer surface of each board would be at a higher temperature than the inside, in view of the temperature within the tank. The reason for the completion of the desired evaporation, even though the temperature measured inside the boards appears to be insufficient, is unknown. One theory could be that as the solvent evaporates from the outer surface of the board, the solvent within the board will tend to dissolve the asphalt in the dried area and, in turn, will itself be evaporated, even though such a phenomenon would normally be expected to take hours, rather than minutes. In any event, the desired results have been secured, as will be evident from FIG. 5.

Figure 5:
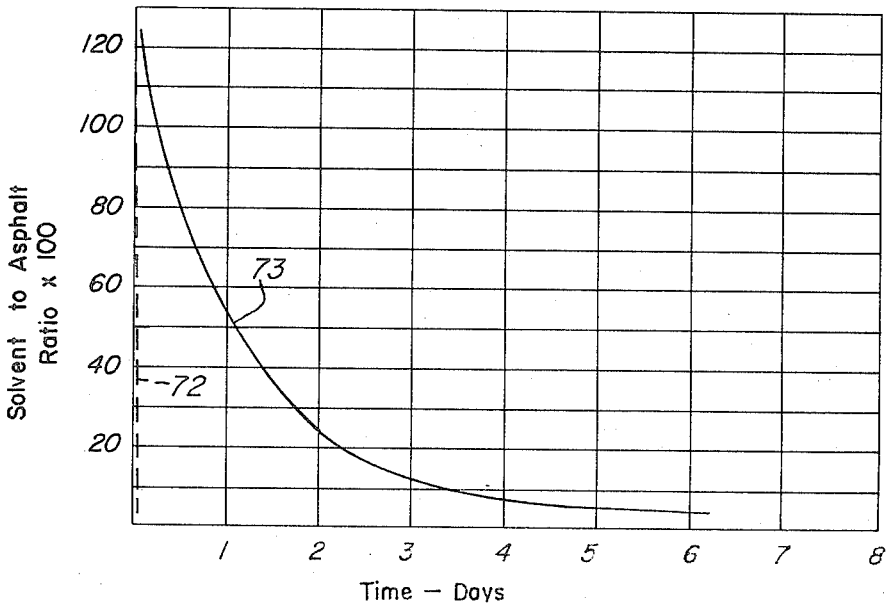
FIG. 5 is a graph showing the proportion of solvent remaining in boards when treated in accordance with the present invention, compared with the prior operation.

A comparison of the method of this invention with the previous method, used by applicant's assignee, is shown by the graph of FIG. 5, in which the ratio of solvent to asphalt (×100) is plotted against the time in days. Curve 72, which illustrates the present invention, shows the drop in the ratio of solvent to asphalt to less than 5, e.g. 5%, in a very short time, such as in approximately 85 minutes or when the boards left the saturation tank. Curve 73, which illustrates the previous method, shows that it required one full day for the ratio to drop to slightly more than 50 another day before it reached approximately 25 and six days before it stabilized at about the same value as the boards of this invention left the treatment tank. There are three outstanding advantages to this unexpected result of this invention. A first is that the solvent is recovered, rather than being lost in the air, and is available for reuse. A second is that the boards do not need to be "aired," i.e. stacked so that the excess solvent may gradually evaporate. Concomitant with the advantage of the lack of requirement to be "aired," is that the boards may immediately be sold or cut into smaller pieces. A third advantage is that the solvent vapor is condensed to a liquid by condenser C, or condensers C and C', so that atmospheric pollution is avoided.

Figure 6:
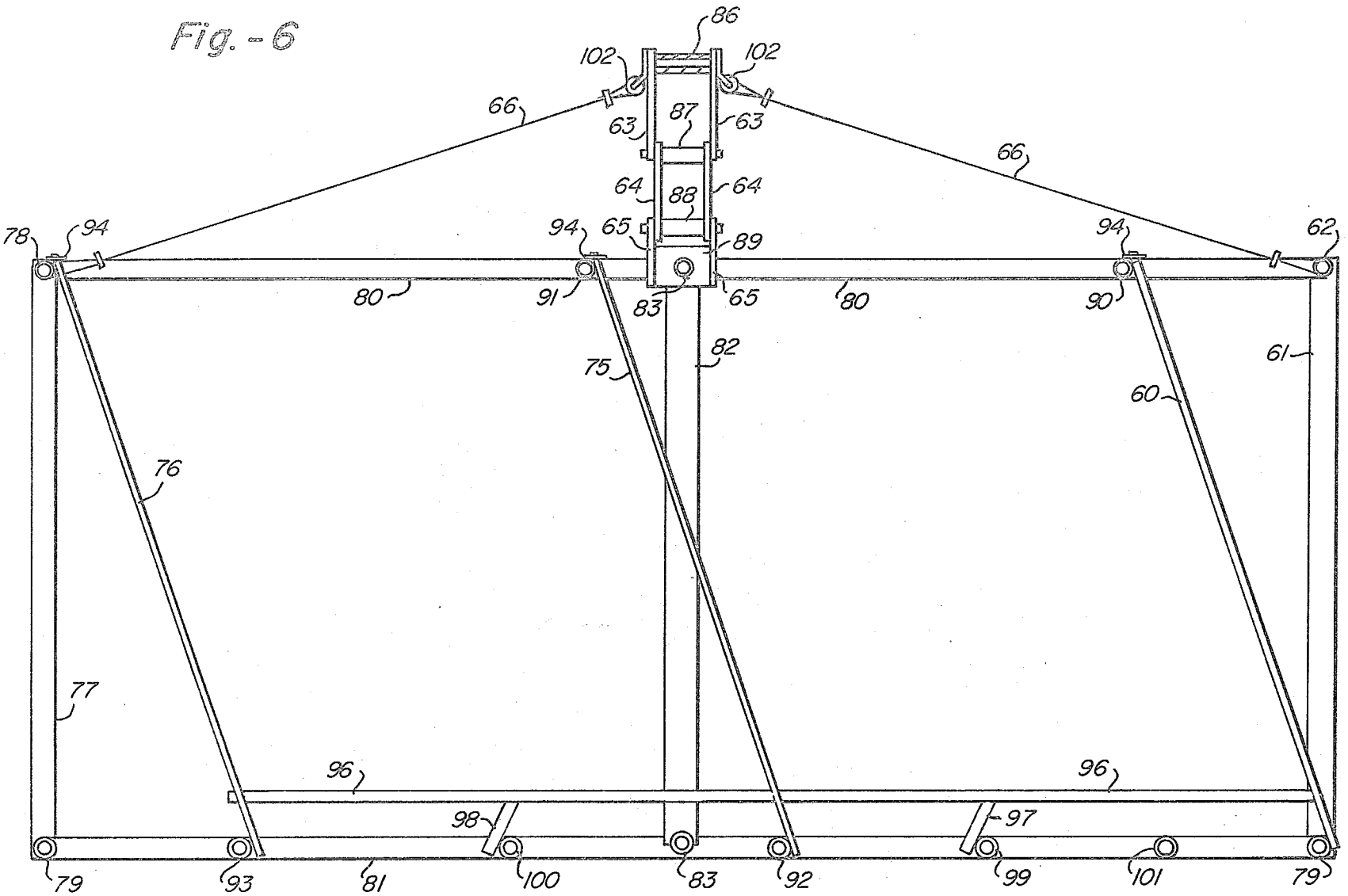
FIG. 6 is a cross section of a rack in which boards are placed for treatment, taken along line 6—6 of FIG. 1 on an enlarged scale.
Figure 7:
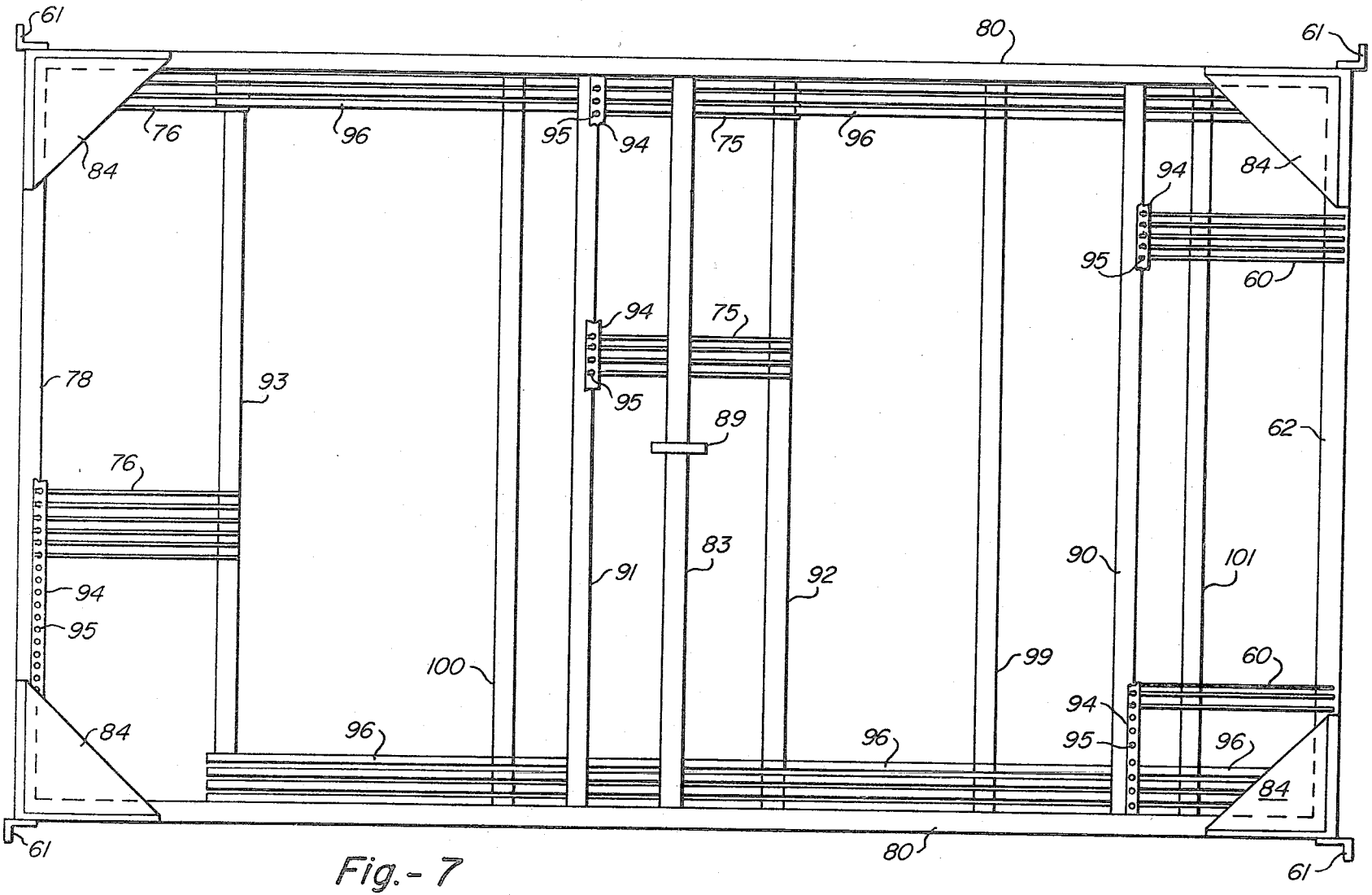
FIG. 7 is a top plan view of the rack of FIG. 6.

The rack R, as shown in FIGS. 6 and 7, further includes a pair of spaced sets of rearwardly inclined bars 75 and 76, parallel to bars 60, referred to previously, as well as a pair of upright rear posts 77, also conveniently formed of angles. The front posts 61 and rear posts 77 are connected at the top and bottom by the front upper rail 62, a rear upper rail 78 and lower rails 79, all conveniently formed of piping. The posts are also connected by upper side rails 80 and lower side rails 81, while a central, upright reinforcing strut 82 extends between the respective pairs of side rails. Central reinforcing tubes 83, such as pipes, extend laterally between the upper and lower rails, respectively, while gusset plates 84 of FIG. 7 reinforce each corner. The parts of the rectangular supporting structure of the rack may be attached together in a suitable manner, as by welding. A sheathed pin 86, as in FIG. 6, for a hoist hook, extends between the upper ends of links 63, in turn pivotally connected by a sheathed pin 87 with links 64, in turn pivotally connected by a sheathed pin 87 with links 64, in turn pivotally connected by sheathed pin 88 with side plates 65. Side plates 65 are attached to a mounting block 89, in turn attached centrally to upper central tube 83.

A pair of tubes 90 and 91, such as pipes, extend transversely between the upper side rails 80, adjacent the upper ends of bars 60 and 75, while the upper ends of bar 76 extend past upper rear tube 78. The lower ends of bars 60 are attached, as by welding, to front lower rail 79, while a pair of tubes 92 and 93, such as pipes, extend transversely between side rails 81 at the lower ends of tubes 75 and 76, respectively, which are attached thereto, as by welding. An expansion bar 94 is attached to each of tubes 90 and 91 and rear tube 78, and each is provided with a series of holes 95 through which the upper ends of guide bars 60, 75 and 76 extend, but without attachment to permit expansion and contraction of the respective bars.

A lower guide rod 96, on which the corresponding fiber board slides during insertion or removal and rests on while in the rack, extends between each pair of aligned bars 60, 75 and 76, each rod 96 being attached, as by welding, to the bar 60, 75 or 76 on each side of the guide rod and also to a pair of oblique, short supporting rods 97 and 98, such as pipes, intermediate the bars 60 and 75 and the bars 75 and 76, respectively. Supporting rod 97 extends upwardly and forwardly from a cross rod 98, as of pipe, extending between lower side rails 81 and to which supporting rod 97 is attached as by welding. Supporting rod 98 extends upwardly and forwardly from a cross rod 100, also extending transversely between lower side rails 81 and to which the rod 98 is attached, as by welding. The supporting structure may be reinforced by a cross tube 101, intermediate front rail 79 and cross rod 99 and extending between and attached, as by welding to lower side rails 81. Cables 66 may be attached to upper links 68 by pivotal connections 102, as shown, to enable links 63 and 64 to be dropped down to reduce the height of the center of the rack when placed within tank T. The remainder of the connections between the various parts of the rack may also be produced by welding.

It will be understood that rack R was developed prior to the present invention, but does appear to be unique in several respects and therefore is not necessarily conventional, being shown for the purpose of disclosing the best mode known to applicants of carrying out the method of this invention.

It will be understood that the fiber boards need not be completely saturated with asphalt, since there are other uses for fiber boards for which less asphalt is satisfactory. For instance, fiber board may be treated with a solution of 25% asphalt and the remainder solvent. Thus, the method and apparatus of the present invention may be utilized for treating fiber boards with such a solution. Also, this invention may be utilized for impregnating fiber boards or other saturable members with material other than asphalt, such as soluble waxes or resins and/or other hydrocarbons, or copper naphthanate as fungicide.

Although more than one embodiment of the method and apparatus of this invention have been shown and described, it will be understood that other embodiments may exist and various changes may be made, without departing from the spirit and scope of this invention.

What is claimed is:

1. A method of impregnating saturable members with asphalt or the like, which comprises:

placing a series of laterally spaced members in an upright position in an enclosable space;

enclosing and sealing said space;

introducing a solution of asphalt and a solvent therefor into said enclosed space to a level corresponding to the upper edges of said members in order to impregnate said members with said solution;

removing solution at the lower portion of said enclosed space, including solution which drains from said members;

applying suction to said enclosed space in order to reduce the pressure therein and produce a vacuum;

supplying heat to said enclosed space;

continuing said suction to reduce the pressure in said enclosed space to a relatively high degree of vacuum;

supplying sufficient heat to said enclosed space so that the treated members will contain a minimum of solvent in addition to asphalt;

condensing the solvent vapors removed by suction from said enclosed space and collecting the condensed solvent for reuse;

discontinuing said suction;

bleeding air into said enclosed space to reduce the vacuum therein and produce an equilization with atmospheric pressure;

unsealing and opening said space; and removing the treated members from said space.

2. A method as defined in claim 1, including:

supplying heat to said enclosed space by a heating medium having a temperature considerably in excess of the boiling point of said solvent at atmospheric pressure.

3. A method as defined in claim 1, wherein:
the amount of solvent in the treated members is equivalent to that obtained by saturating said members with said solution and then drying in the open air.

4. A method as defined in claim 1, wherein:
said solution contains 35% to 39% asphalt.

5. A method as defined in claim 1, wherein:
sufficient heat is supplied to said enclosed space so that the temperature within said enclosed space, at the point of measurement, exceeds the boiling point of said solvent at a relatively low degree of vacuum.

6. A method as defined in claim 1, wherein said suction is produced by a vacuum pump and including:
passing the solvent vapors through two condensers in series between said space and said vacuum pump.

7. A method as defined in claim 1, which includes:
supplying a substantial portion of heat to said space from beneath said members.

8. A method as defined in claim 7, including:
supplying heat to said enclosed space by heaters within a tank having a top, said tank and its top being sealable and providing said enclosed space, said heaters being elongated and substantially less in thickness than in length or width and at least one of said heaters being disposed on the bottom of said tank;
circulating a heating medium through each heater;
placing said members on a movable rack for treatment; and
placing said rack on said bottom heaters during treatment of said members.

9. Apparatus for impregnating saturable members within asphalt or the like comprising:
an upright tank having a bottom, front, rear and end walls;
a cover for said tank which is sealable thereto;
a lower connection for supplying a solution of asphalt and solvent to the interior of said tank;
a rack having an open framework for supporting a series of said members in laterally spaced, upright position;
heating means within said tank, through which a heating medium may be circulated, including at least one elongated heater mounted inside said tank on the bottom and on which said rack is placed for treatment of said members;
an upper connection for applying suction to the interior of said tank;
means for condensing solvent vapor withdrawn from said tank through said upper connection; and
a vacuum pump connected to said means for condensing solvent vapor.

10. Apparatus as defined in claim 9, including:
elongated heaters mounted on the front, rear and each end wall of said tank and each having an inlet for a heating medium at one corner and an outlet at the opposite corner.

11. Apparatus as defined in claim 10, including:
baffles within said heaters alternately extending to and spaced from opposite walls.

12. Apparatus as defined in claim 9, including:
a pair of elongated heaters mounted inside said tank on the bottom; and
means for individually supplying each bottom heater with a heating medium.

13. Apparatus as defined in claim 12, including:
heaters mounted inside said tank on the front, rear and each end wall; and
means for supplying said front, rear and end wall heaters in series with a heating medium.

14. Apparatus for impregnating saturable members with asphalt or the like, comprising:
an upright tank having a bottom, front, rear and end walls;
a cover for said tank which is sealable thereto;
a lower connection for supplying a solution of asphalt and solvent to the interior of said tank;
means for supporting said members in upright position for treatment;
means for supplying heat to the interior of said tank;
an upper connection for applying suction to the interior of said tank;
a vacuum pump for producing suction; and
a pair of condensers, each having a lower condensate section, in series between said upper connection and said vacuum pump.

15. Apparatus for impregnating saturable members with asphalt or the like, comprising:
an upright tank having a bottom, front, rear and end walls;
a cover for said tank which is sealable thereto;
a lower connection for supplying a solution of asphalt and solvent to the interior of said tank;
means for supporting said members in upright position for treatment;
means for supplying heat to the interior of said tank;
an upper connection for supplying suction to the interior or said tank;
a vacuum pump for producing suction;
a condenser having an upper inlet section, an intermediate cooling section and a lower condensate section, whose inlet section is connected with said upper suction connection and the upper portion of whose condensate section is connected with said vacuum pump;
an auxiliary tank having a volume at least equivalent to said condensate section of said condenser; and
piping connecting said auxiliary tank with said condensate section of said condenser.

16. Apparatus for impregnating saturable members with asphalt and the like, comprising:
an upright tank having a bottom, front, rear and end walls;
a cover for said tank which is sealable thereto;
a lower connection for supplying a solution of asphalt and solvent to the interior of said tank;
means for supporting said members for treatment;
means for supplying heat to the interior of said tank;
an upper connection for applying suction to the inerior of said tank;
means for condensing solvent vapor withdrawn from said tank through said upper connection;
a vacuum pump connected by a pipe to said means for condensing solvent vapor; and
a valve controlled pipe, at one end open to the atmosphere and at the opposite end connected to the pipe connecting said vacuum pump and said condensing means.

17. A method as defined in claim 4, wherein:
said members are saturable by immersion in said solution of asphalt and solvent.

18. Apparatus as defined in claim 13, wherein:
said members are saturable by immersion in said solution of asphalt and solvent.

* * * * *